US010944231B2

(12) United States Patent
Gisler et al.

(10) Patent No.: US 10,944,231 B2
(45) Date of Patent: Mar. 9, 2021

(54) METHOD AND DEVICE FOR PROCESSING A CABLE

(71) Applicant: KOMAX HOLDING AG, Dierikon (CH)

(72) Inventors: Adrian Gisler, Eschenbach (CH); Martin Stocker, Küssnacht (CH)

(73) Assignee: KOMAX HOLDING AG, Dierikon (CH)

( * ) Notice: Subject to any disclaimer, the term of this patent is extended or adjusted under 35 U.S.C. 154(b) by 216 days.

(21) Appl. No.: 15/992,378

(22) Filed: May 30, 2018

(65) Prior Publication Data

US 2018/0351316 A1 Dec. 6, 2018

(30) Foreign Application Priority Data

May 31, 2017 (EP) ..... 17173803

(51) Int. Cl.

| | |
|---|---|
| ***H01R 43/04*** | (2006.01) |
| ***H01R 43/28*** | (2006.01) |
| ***B21F 1/00*** | (2006.01) |
| *H01R 43/052* | (2006.01) |
| *H01B 13/012* | (2006.01) |

(52) U.S. Cl.

CPC ..... *H01R 43/28* (2013.01); *B21F 1/002* (2013.01); *H01B 13/01209* (2013.01); *H01R 43/052* (2013.01)

(58) Field of Classification Search

CPC .. H01R 43/05; H01R 43/28; H01L 313/01209
See application file for complete search history.

(56) References Cited

U.S. PATENT DOCUMENTS

| | | | | |
|---|---|---|---|---|
| 2,749,420 | A | 6/1956 | Pityo | |
| 3,360,135 | A | 12/1967 | Horecki | |
| 4,502,586 | A | 3/1985 | Dusel et al. | |
| 4,976,294 | A * | 12/1990 | Kudo | H01R 43/28 140/102 |
| 5,125,154 | A | 6/1992 | Cross | |
| 5,127,159 | A | 7/1992 | Kudo et al. | |
| 5,153,839 | A | 10/1992 | Cross | |
| 5,309,633 | A | 5/1994 | Ricard | |
| 5,522,691 | A * | 6/1996 | Anderson | H01R 43/01 414/781 |
| 5,740,608 | A | 4/1998 | Long | |
| 6,135,164 | A | 10/2000 | Celoudoux et al. | |
| 10,014,644 | B2 * | 7/2018 | Eggimann | B21F 1/00 |

(Continued)

FOREIGN PATENT DOCUMENTS

| | | | |
|---|---|---|---|
| CN | 201219172 | Y | 4/2009 |
| DE | 2549833 | A1 | 6/1976 |
| DE | 3643201 | A1 | 6/1988 |

(Continued)

*Primary Examiner* — Paul D Kim
(74) *Attorney, Agent, or Firm* — William J. Clemens; Shumaker, Loop & Kendrick, LLP

(57) ABSTRACT

A method for processing a cable includes a drawing-out step and a placement step. In the drawing-out step, a loop of the cable is drawn out over a guide body arranged on a loop placement surface. The loop is drawn out to a specified length using a driven dog. In the placement step, the loop is placed onto the loop placement surface by the dog. In the process, the loop is placed over the guide body.

10 Claims, 4 Drawing Sheets

(56) References Cited

U.S. PATENT DOCUMENTS

| | | | | |
|---|---|---|---|---|
| 10,501,283 | B2 * | 12/2019 | Mitchell | B65H 59/10 |
| 2012/0042985 | A1 | 2/2012 | Eggimann et al. | |

FOREIGN PATENT DOCUMENTS

| | | | |
|---|---|---|---|
| EP | 0182592 | A2 | 5/1986 |
| EP | 2421102 | A1 | 2/2012 |
| EP | 3261203 | A1 | 12/2017 |
| JP | H01186777 | A | 7/1989 |
| JP | 2002298664 | A | 10/2002 |
| WO | 9732370 | A1 | 9/1997 |

* cited by examiner

METHOD AND DEVICE FOR PROCESSING A CABLE

FIELD

The present invention relates to a method and a device for processing a cable.

BACKGROUND

In order to produce a cable harness, cables are cut to length from a supply of cable. In the case of long cables, the cable can be shaped into a cable loop in order to save space.

A variant is described in U.S. Pat. No. 5,153,839A. The cables are vertically drawn into a loop by said device and subsequently brought to the individual processing stations by means of a carousel. A machine of this kind is very space-efficient in the horizontal direction. However, the structure becomes very elaborate for cable lengths of six meters or more.

Another approach to processing very long cables in a relatively short machine is to use cable cassettes in which the individual cables are coiled up (U.S. Pat. Nos. 5,125,154A, 5,153,839A). The resulting length of the processed cables can thus be significantly greater in comparison with the overall size of other machine concepts. In contrast, the device from EP0182592A2 uses containers to bring long cables through a processing machine. In this case, the cable is in loops inside the container.

However, all of the aforementioned solutions are difficult or impossible to use for fitting connector housings with a large number of cables.

A device for mechanically producing a partial cable harness having long cables, which device is suitable for processing connector housings having a large number of cables is known from EP2421102A1, for example. A cable is fed to the machine from a supply of cable. A loop is formed by the cable, which loop is extended by being horizontally drawn out. The two cable ends are then transported to the processing station and finally introduced into the corresponding connector housing. The individual cable loops remain in a cable trough in the partial cable harness until they are removed.

However, if long cables are processed at only one end thereof and a connector is fitted with a large number of contacts, the loose ends of the cables become entangled. This happens because the adjacent cable loops are dragged along with the loose cable ends. In this case, the loose ends of the cables move counter to the desired direction, which results in the cables becoming looped and entangled. This makes it considerably more difficult to remove the partial cable harness from the machine, and can lead to significant disruption in production.

There is a solution for preventing entanglement for the manual processing of cables. Hubs, around which the cables are laid, are known from U.S. Pat. No. 3,360,135A. One end of the cables in each case is clamped for later removal. The hubs can prevent the cables from becoming entangled, since the direction of movement of the cables is restricted.

SUMMARY

An object of the invention is that of providing a method and a device which prevents open cable loops from becoming entangled, and thus allows the removal of the partial cable harnesses to be considerably simplified.

The method comprises the following steps:

drawing out a loop of the cable over a guide body arranged on a loop placement surface, the loop being drawn out to a specified length using a driven dog; and placing the loop from the dog onto the loop placement surface, the loop being placed over the guide body.

Furthermore, the device for processing a cable is proposed, the device comprising the following features:

a loop placement surface on which at least one guide body is arranged; and a driven dog designed to draw out a loop of the cable and place said loop over the guide body.

Possible features and advantages of embodiments of the invention may be considered, inter alia, to be based on the concepts and findings described below, without this limiting the invention.

For example, the cable can be fed to the machine from a supply of cable. The method can then take place as follows: The fed-in cable is shaped into a loop and drawn out to the required length. For this purpose, the dog of the loop-drawing module is moved into the inner region of the loop, from which position said dog draws out the loop to the desired length. The loop is then released from the loop-drawing module and falls over at least one guide body onto the loop placement surface. One cable end is also released, such that only one end of the now open loop is drawn through the processing machine. In the process, the guidance by means of the guide body prevents regions of the cable from being displaced counter to the intended direction. Controlling the direction of movement results in small, twisted loops loosening and any possible twisting of the cable slowly unravelling itself. The retained cable end passes through the individual processing stations, the rest of the cable being drawn along behind. Finally, the contact of the retained cable end is brought to the connector fitting station in the provided connector housing. The cables of the partial cable harness which have been processed in this way are retained in a known manner by struts over a cable trough until removal.

A connector can thus be fitted with a large number of contacts without it being possible for the cable to become entangled. Removing the partial cable harness from the machine is thus considerably simplified, and disruptions in production can be prevented.

In a first preferred embodiment, the loop placement surface is a substantially horizontally oriented work surface for placing at least one loop of the cable. In order to draw out the cable, the dog is moved into a starting loop or the starting loop is laid around the dog. The dog is moved so as to be vertically spaced above the loop placement surface. The dog comprises a plurality of elevations which are designed to reduce the contact surface between the cable and the dog.

The curvature of the elevations can be smaller than the minimum permissible bend radius of the cable. However, the number and distribution of the elevations is selected so as not to fall below the minimum permissible bend radius of the cable, which prevents permanent deformation of the cable.

In this case, the minimum permissible bend radius of the cable is the smallest radius into which the cable can be bent without being damaged. Reducing the contact surface allows the cable to slide around the dog with less friction. This is assisted in a positive manner by a correspondingly selected surface. The dog further has an infeed geometry for the cable. The infeed geometry can for example be designed as an infeed region and an outfeed region, such that the cable does not rub against a sharp edge.

The dog is moved above the guide body by means of a drive. In order to place the loop over the guide body, the dog is moved upwards out of the loop.

The guide body is substantially cylindrical and has a radius that is greater than the minimum permissible bend radius of the cable. The contour of the guide body ends flush with the loop placement surface, as a result of which the cable cannot become trapped. The guide body has a taper, in the form of a tip or a ridge, on the upper end thereof. The tip or ridge are preferably rounded. The taper allows the guide body to penetrate a relatively narrow loop. When the cable is placed, the gravitational force causes it to fall downwards from the dog over the tip of the guide body onto the loop placement surface. In this case, the tip of the guide body is oriented towards the central axis of the loop. Furthermore, the tip of the guide body is arranged so as to be laterally offset from the central axis of the guide body. For this purpose, the guide body is cut in an inclined manner. An inclined cut results in a type of elongate tip having a high degree of robustness. In this case, an upper surface of the guide body is arranged at a non-right angle, for example between 10° and 85°, preferably between 30° and 70°, to the vertical.

One side of the loop thus slides laterally over an inclined surface of the guide body, whereas the other side of the loop falls substantially perpendicularly downwards onto the loop placement surface. The guide body is magnetically fastened to the loop placement surface.

The guide body can thus be reversibly and adjustably fastened in different positions along the loop placement surface. It is therefore possible to easily set different lengths for the loop.

Different ranges of loop lengths can be simultaneously covered by means of further guide bodies. For this purpose, the guide bodies are arranged behind one another and so as to be mutually spaced in the longitudinal direction of the loop placement surface.

When the retained cable end is transported onwards to the processing stations, one half of the cable loop is drawn around the guide body and removed from the loop placement surface. This prevents adjacent cable ends from being dragged along in an undesirable direction. At the same time, any possible twisting of the cable can loosen itself.

In a second preferred embodiment, the loop placement surface is contoured. In this case, an incline, or slope, of the loop placement surface can be planar, or slight, to the extent that the cable remains in one place because of the gravitational force thereof. This reduces the risk of the adjacent cables dragging one another along.

A further preferred embodiment comprises a dog having at least one rotatable roller which minimizes the friction between the cable and the dog. If a single roller is used, the radius of the roller is greater than the minimum permissible bend radius of the cable. Using a plurality of rollers or guide rollers can further reduce the friction between the cable and the dog, and decrease the tendency to overrun. The cable is thus protected as far as possible. In this case, the infeed geometry is inclined and/or rounded, for example. Furthermore, the infeed geometry can also be funnel-shaped, for example. As a result of the infeed geometry, when being drawn out, the cable can move around the dog without being damaged. In order to place the loop, the dog is moved out of the loop. For example, the dog can be moved back while the loop remains open. The loop then falls over the guide body.

It is noted that some of the possible features and advantages of the invention are described herein with reference to different embodiments. A person skilled in the art recognizes that the features of the method and of the device may be combined, adapted or exchanged as appropriate in order to yield further embodiments of the invention.

Embodiments of the invention are described in the following with reference to the accompanying drawings, neither the drawings nor the description being intended to be interpreted as limiting to the invention.

The drawings are only schematic, and are not true to scale. Identical reference signs refer in the different drawings to identical features, or to features having an identical effect.

DETAILED DESCRIPTION

Figure 1:
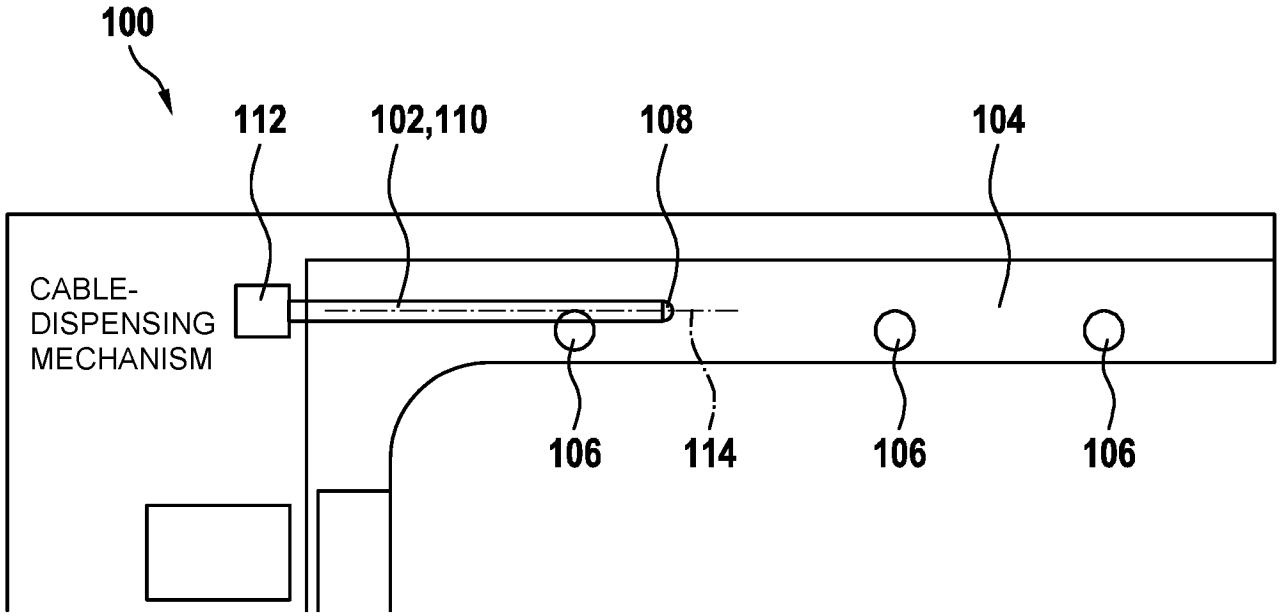
FIG. 1 shows a device for processing a cable according to an embodiment.

FIG. 1 shows a device 100 for processing a cable 102 according to an embodiment. In this case, the device 100 is a component of a cable harness processing machine. The device 100 comprises a loop placement surface 104 and a plurality of guide bodies 106 arranged thereon. The guide bodies 106 project upwards from the loop placement surface 104. The guide bodies 106 have a circular cross-sectional area. A motor-driven dog 108 is arranged above the loop placement surface 104. The dog 108 is mounted so as to be linearly movable in a draw-out direction. The dog 108 is designed to draw out a loop 110 of the cable 102 to a desired length, and to place said loop over at least one of the guide bodies 106 and onto the loop placement surface 104.

For the drawing-out process, the dog 108 is moved towards a cable-dispensing mechanism 112 by means of the drive mechanism (not shown here) of said dog. There, the dog 108 is moved into a starting loop, or the starting loop is laid around the dog 108. The dog 108 is subsequently moved in the draw-out direction by the drive mechanism, thereby drawing out the loop 110.

The loop 110 is long enough when the two ends of the cable 102 together result in a desired cable length. When the loop 110 is long enough, i.e. the dog 108 has been moved to a position determined by the desired cable length, the dog 108 places the loop 110 over at least one of the guide bodies 106 and onto the loop placement surface 104. For this purpose, the dog 108 is withdrawn from the loop 110 by the drive mechanism. It is equally possible to move the dog 108 in a direction counter to the draw-out direction by means of the driving mechanism so that the cable 102 falls from the dog 108 and onto the loop placement surface 104.

When the loop 110 is at the desired length, the end of the loop 110 that is connected to the supply of cable is detached at the cable dispensing mechanism 112. Said end is thus freed.

The cable 102 is removed around the guide body 106 in order to be further processed in the cable harness processing machine. When removed, the loose end of the cable 102 relaxes. The remaining twisting is stripped out of the cable 102 by the guide body 106.

Figure 2:
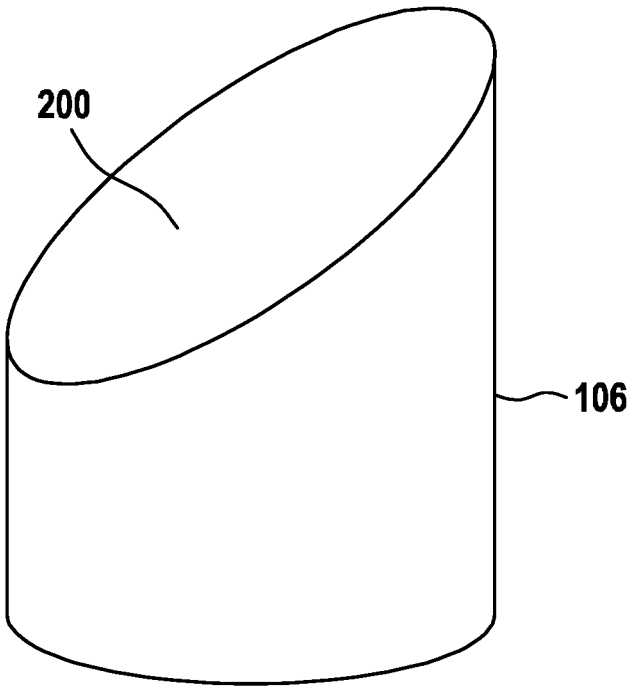
FIG. 2 shows a guide body of a device for processing a cable according to an embodiment.

FIG. 2 shows a guide body 106 having a cylindrical main part. The guide body substantially corresponds to one of the guide bodies in FIG. 1. In order to form a tip, the top of the guide body 106 is cut in an inclined manner. As a result of the inclined cut, the guide body 106 comprises, on the upper face thereof, a continuous surface 200 which is inclined on one side, over which surface the cable slides laterally when placed over the guide body 106. The tip is arranged so as to be laterally offset with respect to the lateral surface of the cylinder.

Figure 3:
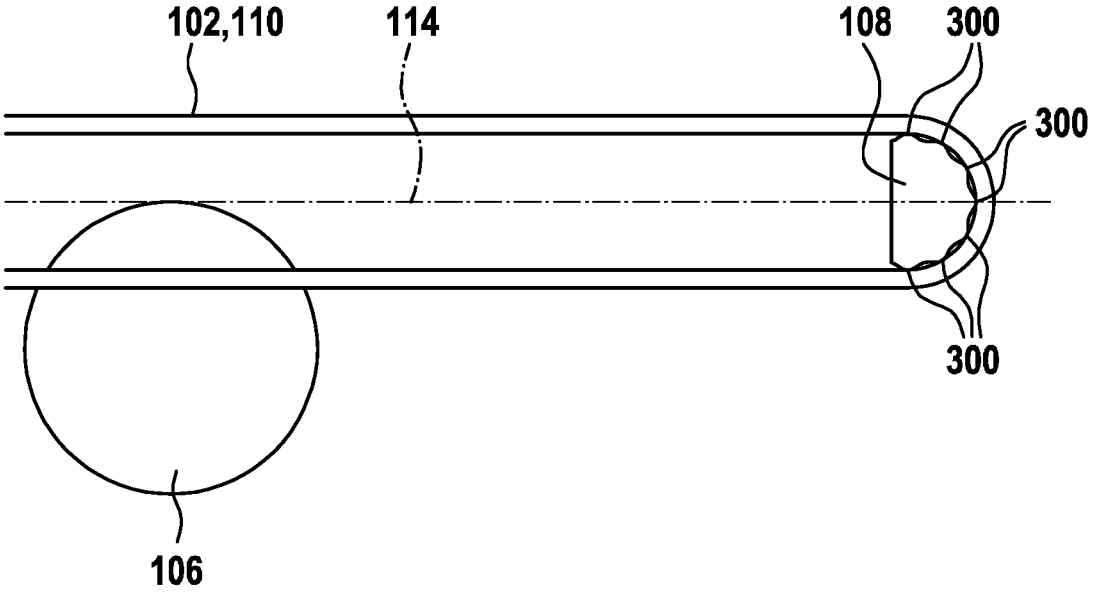
FIG. 3 shows a dog and a guide body of a device for processing a cable according to an embodiment.

FIG. 3 shows a dog 108 and a guide body 106 of a device for processing a cable 102 according to an embodiment. The guide body 106 and the dog correspond substantially to the drawings in FIGS. 1 and 2. The dog 108 additionally has friction-reducing surface shaping. For this purpose, the dog 108 comprises a plurality of elevations 300 oriented transversely to the cable 102, for example in the form of ribs oriented transversely to a curvature of the dog 108, on which ribs the cable 102 rests and which ribs reduce the contact surface to the loop surface. The cable 102 does not touch the dog 108 between the elevations 300 and therefore cannot cause friction. The embodiment of the elevations 300 and the surface properties thereof depend on the properties of the cable 102 to be processed.

In this case, the distribution and number of elevations 300 are selected such that the minimum permissible bend radius of the cable 102 is not fallen short of, below which radius the cable 102 deforms plastically. Moreover, the contour of the elevations 300 is selected such that displacements of the cable insulation material are reduced to a minimum. The dog 108 further comprises an infeed region on each side in order to minimize damage to the cable 102 caused by the oscillations of said cable itself while the loop 110 is being drawn out.

The tip of the guide body 106 is aligned with the central axis 114 of the loop 110. One side of the loop 110 therefore slides over the inclined surface of the guide body 106 and to the side, and the two sides of the loop 110 come to rest on different sides of the guide body 106.

Figure 4:
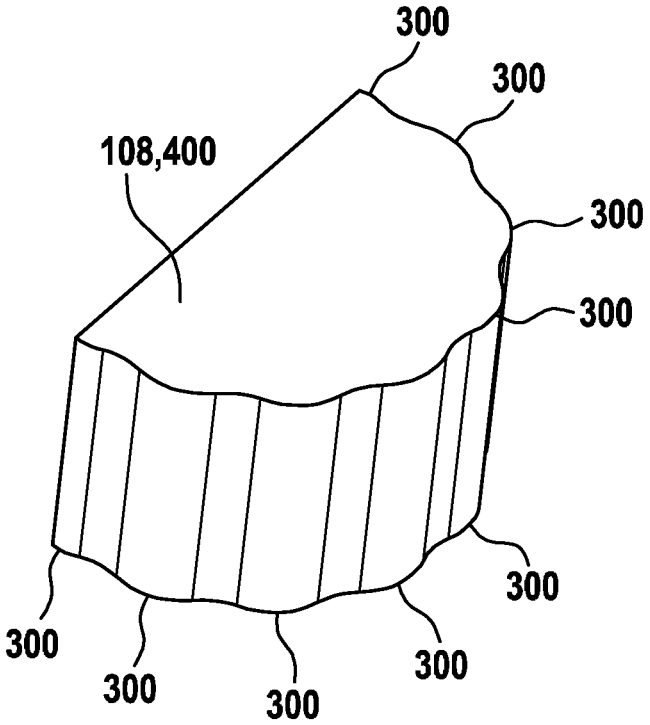
FIG. 4 shows a dog for a device for processing a cable according to an embodiment.

FIG. 4 shows a dog 108 for a device for processing a cable according to an embodiment. The dog 108 substantially corresponds to the dog in FIG. 3. The dog 108 comprises a substantially semicylindrical main part 400. Eight elevations 300 are arranged on the curved portion of the lateral surface thereof. The elevations are oriented in parallel with a longitudinal axis of the main part 400.

Figure 5:
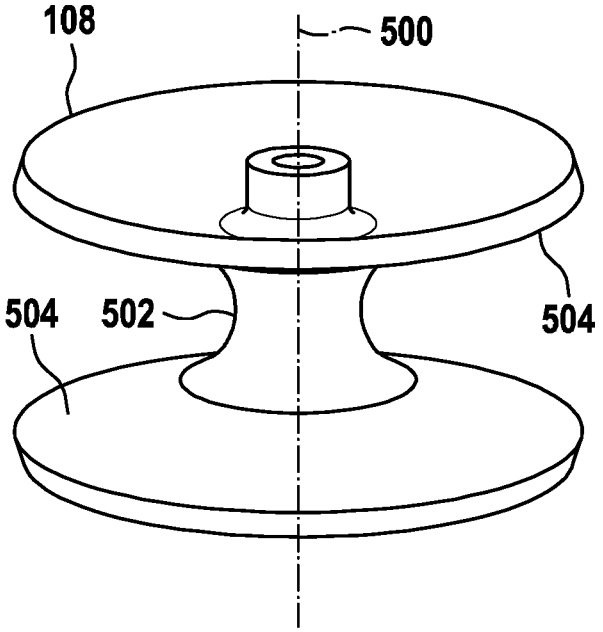
FIG. 5 shows a dog in the form of a roller for a device for processing a cable according to an embodiment.

FIG. 5 shows a dog 108 in the form of a roller for a device for processing a cable according to an embodiment. The dog 108 can be used as the dog in FIG. 1, for example. In this case, the dog 108 comprises a cable sheave 502 which is mounted so as to be rotatable about a rotational axis 500. The cable sheave 502 comprises a peripheral groove for laterally guiding the cable. The dog 108 further has an infeed geometry 504. The infeed geometry 504 adjoins both sides of the cable sheave 502 and can rotate along with the cable sheave 502 about the rotational axis 500. The infeed geometry 504 is designed on both sides as an inclined collar projecting from the cable sheave 502. The infeed geometry 504 prevents the cable from slipping off the cable sheave 502, even if the cable does not extend perpendicularly to the rotational axis 500.

In other words, in this case a single guide roller forms the dog 108 for cables having very soft and adhesive insulation material.

Figure 6:
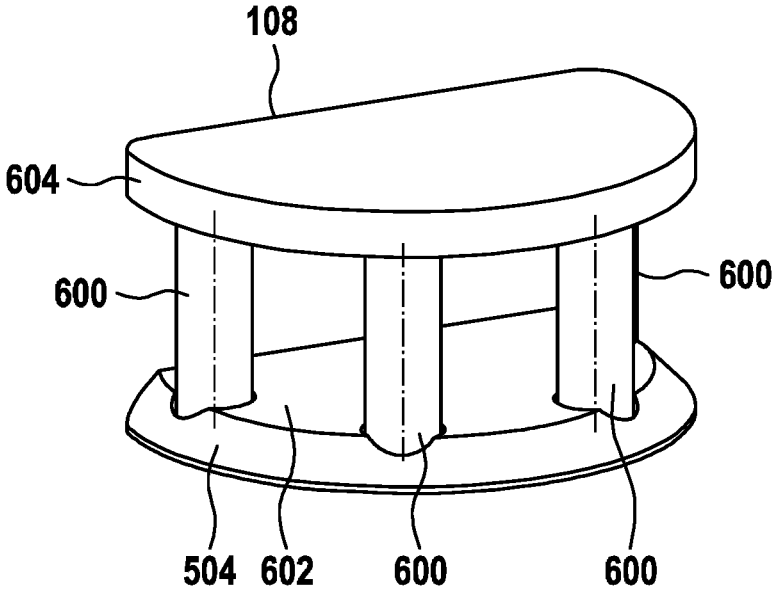
FIG. 6 shows a dog having a plurality of rollers for a device for processing a cable according to an embodiment.

FIG. 6 shows a dog 108 having a plurality of rollers 600 for a device for processing a cable according to an embodiment. The dog 108 substantially corresponds to the dog in FIG. 4. In contrast thereto, in this case the dog 108 comprises four rotatably mounted rollers 600 instead of the elevations. The rollers 600 are mounted in recesses of a base plate 602 and of a cover plate 604. The rollers 600 are cylindrical and the distribution and number thereof is selected such that the minimum permissible bend radius of the cable 102 is not fallen short of. The base plate 602 and the cover plate 604 are substantially semicircular and project beyond the rollers 600, which are arranged in a semicircular manner. At least the base plate 602 has an infeed geometry 504. In this case, the infeed geometry 504 is designed as a semicircular peripheral chamfer.

In other words, the dog 108 comprises a group of rollers 600 having a small rotational moment of inertia, which causes the rollers 600 to overrun slightly. The forces acting on the cable are thus significantly reduced, which is important in the case of sensitive cables which have a very small cross section and thin insulation.

Finally, it should be noted that expressions such as 'comprising' and the like do not preclude other elements or steps, and expressions such as 'a' or 'one' do not preclude a plurality.

It should also be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for processing a cable, the method comprising the steps of:

drawing a loop of the cable over a guide body arranged on a loop placement surface, the loop being drawn out to a specified length by a driven dog;

placing the loop from the dog onto the loop placement surface, wherein the loop is placed over the guide body; and removing the cable from the loop placement surface around the guide body by pulling a first end of the loop.

2. The method according to claim 1 wherein, in the drawing-out step, a first end of the cable is fixed and the loop is drawn out around the dog.

3. The method according to claim 1 wherein, in the drawing-out step, the loop is drawn out over at least one further guide body arranged on the loop placement surface.

4. A device for processing a cable, the device comprising:

a loop placement surface on which at least one guide body is arranged wherein the at least one guide body is tapered at an upper end thereof; and a driven dog adapted to draw out a loop of the cable and place the loop over the at least one guide body.

5. The device according to claim 4 wherein the at least one guide body is cut at an incline at an upper end thereof.

6. The device according to claim 4 wherein the at least one guide body has a tip aligned with a central axis of the loop.

7. The device according to claim 4 wherein the at least one guide body is magnetically fastened to the loop placement surface.

8. A device for processing a cable, the device comprising:

a loop placement surface on which at least one guide body is arranged;

a driven dog adapted to draw out a loop of the cable and place the loop over the at least one guide body; and wherein the dog includes a plurality of elevations that reduce a contact surface between the cable and the dog, wherein a distribution and a number of the elevations are selected to form a bend radius of the loop that is greater than a minimum permissible bend radius of the cable to prevent plastic deformation of the cable.

9. The device according to claim 8 wherein the dog includes a semicylindrical main part having a curved portion of a lateral surface of the main part and the elevations are arranged on the curved portion.

10. A device for processing a cable, the device comprising:

a loop placement surface on which at least one guide body is arranged wherein the at least one guide body is magnetically fastened to the loop placement surface; and a driven dog adapted to draw out a loop of the cable and place the loop over the at least one guide body.

* * * * *